US007716890B2

(12) United States Patent
Boxall et al.

(10) Patent No.: US 7,716,890 B2
(45) **Date of Patent: *May 18, 2010**

(54) TAPERED LOAD PLATE FOR TRANSFERRING LOADS BETWEEN CAST-IN-PLACE SLABS

(76) Inventors: Russell Boxall, c/o PNA Construction Technologies, Inc., 9 Dunwoody Park, Suite 111, Atlanta, GA (US) 30338; Nigel K. Parkes, c/o PNA Construction Technologies, Inc., 9 Dunwoody Park, Suite 111, Atlanta, GA (US) 30338

( * ) Notice: Subject to any disclaimer, the term of this patent is extended or adjusted under 35 U.S.C. 154(b) by 29 days.

This patent is subject to a terminal disclaimer.

(21) Appl. No.: 12/135,780

(22) Filed: Jun. 9, 2008

(65) Prior Publication Data

US 2008/0236091 A1 Oct. 2, 2008

Related U.S. Application Data

(63) Continuation of application No. 10/489,380, filed as application No. PCT/US02/29200 on Sep. 13, 2002, now Pat. No. 7,481,031.

(60) Provisional application No. 60/318,838, filed on Sep. 13, 2001.

(51) Int. Cl.
*E04B 1/682* (2006.01)

(52) U.S. Cl. ..... 52/396.02; 52/402; 52/426; 52/585.1; 404/57; 404/60

(58) Field of Classification Search ..... 52/393, 52/395, 396, 396.02, 396.04, 396.05, 396.07, 52/396.08, 402, 426, 435, 677, 585.1; 404/47, 404/51, 52, 55, 56, 57, 58, 59, 60–67, 134–136
See application file for complete search history.

(56) References Cited

U.S. PATENT DOCUMENTS 94,066 A 8/1864 Betteley (Continued)

FOREIGN PATENT DOCUMENTS

AT 348222 10/1977

(Continued)

OTHER PUBLICATIONS

May 2, 2008 Order Denying Preliminary Injunction.

(Continued)

*Primary Examiner*—Richard E Chilcot, Jr.
*Assistant Examiner*—William V Gilbert
(74) *Attorney, Agent, or Firm*—Banner & Witcoff, Ltd.

(57) ABSTRACT

A tapered load plate transfers loads across a joint between adjacent concrete floor slabs. The top and bottom surfaces may taper from approximately 4 inches wide to a narrow substantially pointed end over a length of approximately 12 inches. The tapered load plate accommodates differential shrinkage of cast-in-place concrete slabs. When adjacent slabs move away from each other, the narrow end of the tapered load plate moves out of the void that it created in the slab thus allowing the slabs to move relative to one another in a direction parallel to the joint. Tapered load plates may be assembled into a load-plate basket with the direction of the taper alternating from one tapered load plate to the next to account for off-center saw cuts. A tapered load plate and an end cap may be used to provide load transfer across an expansion joint.

13 Claims, 12 Drawing Sheets

U.S. PATENT DOCUMENTS

| | | | | | |
|---|---|---|---|---|---|
| 602,769 | A | | 4/1898 | Parker | |
| 714,971 | A | | 12/1902 | Thacher | |
| 748,746 | A | | 1/1904 | Kelsey | |
| 811,560 | A | | 2/1906 | Hinchman | |
| 828,550 | A | | 8/1906 | Inman et al. | |
| 0,881,762 | A | | 3/1908 | Adreon, Jr. | |
| 920,808 | A | | 5/1909 | Alcott | |
| 1,092,734 | A | | 4/1914 | McLoughlin | |
| 1,298,018 | A | | 3/1919 | Davis | |
| 1,557,165 | A | | 10/1925 | Hooper | |
| 1,632,395 | A | | 6/1927 | Fellows | |
| 1,753,316 | A | | 4/1930 | Robertson | |
| 1,894,395 | A | | 1/1933 | Burrell | |
| 2,064,528 | A | | 12/1936 | Fischer | |
| 2,103,337 | A | | 12/1937 | Oury | |
| 2,121,303 | A | | 6/1938 | Robertson | |
| 2,149,467 | A | | 3/1939 | Robertson | |
| 2,167,904 | A | | 8/1939 | Older | |
| 2,193,129 | A | | 3/1940 | Geyer | |
| 2,201,134 | A | * | 5/1940 | Brickman et al. | 404/57 |
| 2,207,168 | A | | 7/1940 | Thomas | |
| RE21,996 | E | * | 1/1942 | Oates | 404/61 |
| 2,308,677 | A | | 1/1943 | Dailey | |
| 2,309,538 | A | | 1/1943 | Robertson | |
| 2,316,233 | A | | 4/1943 | Fischer | |
| 2,319,972 | A | | 5/1943 | Brickman | |
| 2,337,156 | A | | 12/1943 | Elmendorf | |
| 2,349,983 | A | | 5/1944 | Musall | |
| 2,416,584 | A | | 2/1947 | Heltzel | |
| 2,441,903 | A | | 5/1948 | Robertson | |
| 2,509,180 | A | * | 5/1950 | Yeoman | 404/57 |
| 2,531,040 | A | | 11/1950 | Heltzel | |
| 2,589,815 | A | | 3/1952 | Jacobson | |
| 2,654,297 | A | * | 10/1953 | Nettleton | 404/52 |
| 2,775,924 | A | | 1/1957 | Brickman | |
| 3,104,600 | A | * | 9/1963 | White | 52/688 |
| 3,246,433 | A | | 4/1966 | Eriksson | |
| 3,331,623 | A | | 7/1967 | Baresel-Bofinger | |
| 3,430,406 | A | | 3/1969 | Weber | |
| 3,434,263 | A | | 3/1969 | Beckman et al. | |
| 3,559,541 | A | | 2/1971 | Watstein | |
| 3,561,185 | A | | 2/1971 | Finsterwalder et al. | |
| 3,855,754 | A | | 12/1974 | Scoville | |
| 3,859,769 | A | | 1/1975 | Watkins | |
| 3,960,460 | A | | 6/1976 | Fischer | |
| 4,091,589 | A | | 5/1978 | Moot | |
| 4,257,207 | A | | 3/1981 | Davis | |
| 4,353,666 | A | | 10/1982 | Brandley | |
| 4,373,829 | A | | 2/1983 | Braxell | |
| 4,453,360 | A | | 6/1984 | Barenberg | |
| 4,531,564 | A | | 7/1985 | Hanna | |
| 4,641,988 | A | | 2/1987 | Ganner | |
| 4,733,513 | A | | 3/1988 | Schrader et al. | |
| 4,883,385 | A | | 11/1989 | Kaler | |
| 4,996,816 | A | | 3/1991 | Wiebe | |
| 5,005,331 | A | | 4/1991 | Shaw et al. | |
| 5,216,862 | A | | 6/1993 | Shaw et al. | |
| 5,261,194 | A | | 11/1993 | Roberts | |
| 5,261,635 | A | | 11/1993 | Flathau | |
| 5,366,319 | A | | 11/1994 | Hu | |
| 5,419,965 | A | | 5/1995 | Hampson | |
| 5,439,308 | A | | 8/1995 | Beaulieu | |
| 5,458,433 | A | | 10/1995 | Stastny | |
| 5,487,249 | A | | 1/1996 | Shaw et al. | |
| 5,560,151 | A | | 10/1996 | Roberts | |
| 5,574,028 | A | | 11/1996 | Bodick | |
| 5,623,799 | A | | 4/1997 | Kowalski | |
| 5,640,821 | A | | 6/1997 | Koch | |
| 5,674,028 | A | * | 10/1997 | Norin | 404/74 |
| 5,713,174 | A | | 2/1998 | Kramer | |
| 5,730,544 | A | | 3/1998 | Dils et al. | |
| 5,797,231 | A | | 8/1998 | Kramer | |
| 5,941,045 | A | | 8/1999 | Plehanoff | |
| 6,019,546 | A | | 2/2000 | Ruiz | |
| 6,052,964 | A | | 4/2000 | Ferm | |
| 6,145,262 | A | | 11/2000 | Schrader et al. | |
| 6,195,956 | B1 | | 3/2001 | Reyneveld | |
| 6,354,053 | B1 | | 3/2002 | Kerrels | |
| 6,354,760 | B1 | * | 3/2002 | Boxall et al. | 404/56 |
| 6,471,441 | B1 | * | 10/2002 | Muller | 404/62 |
| 6,532,714 | B1 | | 3/2003 | Ferm | |
| 6,926,463 | B2 | | 8/2005 | Shaw | |
| 7,004,443 | B2 | | 2/2006 | Bennett | |
| 7,201,535 | B2 | | 4/2007 | Kramer | |
| 7,228,666 | B2 | | 6/2007 | Michiels | |
| 7,338,230 | B2 | | 3/2008 | Shaw et al. | |
| 7,441,985 | B2 | | 10/2008 | Kelly et al. | |
| 2006/0177267 | A1 | * | 8/2006 | Carroll | 404/47 |
| 2007/0231068 | A1 | | 10/2007 | Francies et al. | |

FOREIGN PATENT DOCUMENTS

| | | | |
|---|---|---|---|
| CH | 594106 | | 12/1977 |
| DE | 894706 | | 9/1942 |
| DE | 726829 | | 9/1953 |
| DE | 152821 | | 9/1981 |
| EP | 032105 | B1 | 7/1981 |
| EP | 0059171 | A1 | 9/1982 |
| EP | 0328484 | A1 | 8/1989 |
| GB | 2285641 | A | 7/1995 |
| WO | 96/39564 | | 12/1996 |
| WO | WO99/31329 | | 6/1999 |
| WO | WO/2004/065694 | A1 | 8/2004 |

OTHER PUBLICATIONS

Feb. 22, 2008 Memorandum in support of motion for preliminary injunction based on infringement of U.S. Patent No. 6,354,760.

Apr. 7, 2008 Response in opposition to the motion for preliminary injunction based on infringement of the U.S. Patent No. 6,354,760.

(Court Pleading) *P.N.A. Construction Technologies Inc.* v. *McTech Group, Inc., et al.,* "Memorandum in Support of Plaintiff P.N.A. Construction Technologies, Inc.'s Motion for Preliminary Injunction" and Exhibits A-P, Aug. 12, 2005, 60 pages, filed in the United States District Court for the Northern District of Georgia, Atlanta Division, Court No. 1:05-cv1753-WSD.

(Court Pleading) *P.N.A. Construction Technologies, Inc.* v. *McTech Group, Inc., et al.,* "Defendants McTech Group, Inc.'s McDonald Technology Group, LLC's, and Stephen F. McDonald's Opposition to Plaintiff's Motion for a Preliminary Injunction," Aug. 24, 2005, Page Nos. (top labeled) 1 (cover) and 13-21, filed in the United States District Court for the Northern District of Georgia, Atlanta Division, Court No. 1:05-cv-1753-WSD.

(Court Pleading) *P.N.A. Construction Technologies, Inc.* v. *McTech Group, Inc., et al.,* "Plaintiff's Responses and Objections to Defendants' first Set of Interrogatories," Sep. 26, 2005, p. Nos. 1 (cover) and 12-13 (Interrogatory No. 7/Answer to Interrogatory No. 7), filed in the United States District Court for the Northern District of Georgia, Atlanta Division, Court No. Court No. 1:05-cv-1753-WSD.

(Court Pleading) *P.N.A. Construction Technologies, Inc.* v. *McTech Group, Inc., et al.,* "Plaintiff P.N.A. Construction Technologies, Inc.'s Supplemental Memorandum in Support of Its Motion for a Preliminary Injuction," Oct. 31, 2005, p. Nos. 1 (cover) and 12-21 (bottom labeled), filed in the United States District Court for the Northern District of Georgia, Atlanta Division, Court No. 1:05-cv-1753-WSD.

(Drawing Sheet) PNA Construction Technologies Inc., "PNA Square Dowel Basket Isometric," Current, Sheet SDB-1, Jun. 2004, Atlanta, GA, 1 page.

(Court Pleading) *P.N.A. Construction Technologies, Inc.* v. *McTech Group, Inc., et al.,* "Plaintiff's Responses and Objections to Defendants' First Set of Requests for Admission (Nos. 1-3)," Nov. 21, 2005, p. Nos. 1 and 3, filed in the United States District Court for the Northern District of Georgia, Atlanta Division, Court No. 1:05-cv-1753-WSD.

(Court Pleading) *P.N.A. Construction Technologies, Inc.* v. *McTech Group, Inc., et al.,* "Order," Feb. 8, 2006, p. Nos. 1-31, filed in the United States District Court for the Northern District of Georgia, Atlanta Division, Court No. 1:05-cv-1753-WSD.

(Court Pleading) *P.N. A. Construction Technologies, Inc.* v. *McTech Group, Inc., et al.,* "Consent Judgment and Permanent Injunction," May 4, 2006, p. Nos. 1-3, filed in the United States District Court for the Northern District of Georgia, Atlanta Division, Court No. 1:05-cv-1753-WSD.

(Deposition Transcript) *P.N.A. Construction Technologies, Inc.* v. *McTech Group, Inc., et al.,* Deposition transcript of Nigel K. Parkes, Oct. 5, 2005, p. Nos. 51-58, Atlanta, GA.

(Report) ACI Committee 360, "Design of Slabs-on-Ground, ACI 260R-06," Aug. 9, 2006, p. Nos. 360R-1 to 360R-74.

(Report) ACI Committee 302, "Guide for Concrete Floor and Slab Construction, ACI 302.1R-04," Mar. 23, 2004, p. Nos. 302.1R-1 to 302.1R-77.

(Magazine Article) Wayne W. Walker and Jerry A. Holland, "Performance-Based Dowel Deisgn, Lift-truck design changes require a new look at joint durability," Concrete Construction—The World of Concrete, Jan. 2007 World of Concrete Official Show Issue, Hanley Wood, pp. 1-8.

(Magazine Article) Nigel Parkes, "A Decade of Dowel Development," L&M Concrete News, Jan. 2007: vol. 7, No. 1, p. Nos. Cover, 8-10.

(Magazine Article) Wayne W. Walker and Jerry A. Holland, "Plate Dowels for Slabs on Ground," American Concrete Institute—Concrete International, Jul. 1998, p. Nos. Cover, 32-38.

(Magazine Article) Ernest K. Schrader, "A Solution to Cracking and Stresses Caused by Dowels and Tie Bars," American Concrete Institute—Concrete International, Jul. 1991, p. Nos. unknown (6 pgs. total).

(Magazine Article) Greg K. Fricks and Nigel K. Parkes, "Innovations for Durable Floors," Concrete Construction, The World of Concrete, Jan. 2002 by Hanley-Wood Publication, p. Nos. unknown (4 pgs. total).

(Magazine Article) Gregory Scurto, David Scurto, Wayne W. Walker, and Jerry A. Holland, "Cost-Effective Slabs-on-Ground," American Concrete Institute—Concrete International, May 2004, p. Nos. 65-67.

(Web Page) PNA Construction Technologies, "Square Dowel Baskets," Current, 1 page printed from PNA website found under "Products."

(Product Instructions) PNA Construction Technologies, "PD3 Basket Assembly Instructions for Use," Source: American Concrete Association, R&T Update, "Dowel Basket Tie Wires: Leaving Them Intact Does Not Affect Pavement Performance," Jan. 2005, 1 page.

(Brochure) PNA Construction Technologies, "PD3 Basket Assembly," Source Material: Concrete Construction, "Performance-Based Dowel Design," Jan. 2007, Wayne Walker and Jerry Holland, 1 page.

(Drawing Sheet) PNA Construction Technologies, "PNA PD3 Basket Assembly Isometric," Current, Sheet PD3-1, Aug. 2006, Atlanta, GA, 1 page.

(Photographs and Diagrams) PNA Construction Technologies' unpublished photographs of product installation images for Boxall and PD3 Dowel Plates, Current, 4 pages.

(Magazine Article) Wayne W. Walker and Jerry A. Holland, Thou Shalt Not Curl Nor Crack . . . (hopefully), Concrete International, Jan. 1999, 7 pages.

(Seminar Booklet) Steve Metzger and Metzger/McGuire, "Handling Joints In Industrial Concrete Floors," World of Concrete 2005, Las Vegas, NV, 28 pages.

(Manuscript) Nigel K. Parkes, "Improved Load Transfer and Reduced Joint Spelling Systems for both Construction and Contraction Joints," International Colloquium of Industrial Floors, Jan. 2003, Esslingen, Germany, 11 pages.

(Magazine Article) Greg K. Fricks and Nigel K. Parks, "Innovations for Durable Floors," Concrete Construction, The World of Concrete, Jan. 2002 Hanley-Wood Publication, 4 pages.

(Magazine Article) Nigel Parkes, "Designing the Cost-Effective Slab-on-Ground Least Likely to Crack or Spall," Structure Magazine, Apr. 2007, p. Nos. 10-12.

Ralph E. Spears, "Concrete Floors on Ground," Portland Cement Association, Second Edition (1983).

American Concrete Pavement Association, "Design and Construction of Joints for Concrete Highways" (1991).

American Concrete Pavement Association, "Design and Construction of Joints for Concrete Streets" (1992).

American Concrete Institute, ACI Committee 302, "Guide for Concrete Floor and Slab Construction," ACI 302.1R-96 (1997).

Laser Form pamphlet entitled: "Who's going to use Laser Form first? You or your competition?".

Laser Form brochure entitled: "Who's going to use Laser Form first? You or your competition?".

(Court Pleading) *Greenstreak Group, Inc.* v. *P.N.A. Construction Technologies, Inc.,* Court No. 4:07-CV-02099-DJS, "Plaintiff's Second Supplemental Objections and Responses to Interrogatory No. 2 of P.N.A. Construction Technologies' First Set of Interrogatories to Greenstreak," (including Exhibit A), Filed Jul. 10, 2008, pp. 16.

Shrader, "A Proposed Solution to Cracking Caused by Dowels," Concrete Construction (Dec. 1987).

William F. Perenchino, Avoiding Common Mistakes in Concrete Joint Design, Construction Renovation Facilities, reprinted from Plant Engineering, Jan. 11, 1990, Cahners Publishing Company, pp. 5.

William Van Breemen and E. A. Finney, "Design and Construction of Joints in Concrete Pavements," Journal of the American Concrete Institute, Jun. 1950, pp. 789-879.

Arnold, "Diamond Dowels for Slabs on Ground," Concrete (Jun. 1998).

Arnold, "Joint Armouring and Load Transfer," Concrete (Sep. 2006).

E. A. Finney, "Structural Design Considerations for Pavement Joints," Title No. 53-1, part of copyrighted Journal of The American Concrete Institute, V. 28, No. 1, Jul. 1956.

Portland Cement Association, Concrete Floors on Ground (2d ed. 1983).

The Concrete Society, Technical Report No. 34: Concrete Industrial Ground Floors (3d ed. 2003).

Greenstreak, "Laser Form Job Site Guide" (undated).

Bolourchi, et al., "Federal Highway Administration Technical Report FHWA-LA-97, Evaluation of Load Transfer Devices (Patent 4,453,360)," Nov. 1975.

* cited by examiner

TAPERED LOAD PLATE FOR TRANSFERRING LOADS BETWEEN CAST-IN-PLACE SLABS

This is a continuation of application Ser. No. 10/489,380, filed Mar. 12, 2004, which claims priority to PCT Application No. PCT/US02/29200, filed Sep. 13, 2002, which in turn claims priority to U.S. Provisional Application Ser. No. 60/318,838, filed Sep. 13, 2001, all of which are incorporated by reference in their entirety herein.

TECHNICAL FIELD

This invention relates generally to transferring loads between adjacent cast-in-place slabs and more particularly to a system for transferring, across a joint between a first slab and a second slab, a load applied to either slab.

BACKGROUND OF THE INVENTION

Referring to FIG. 1, when a concrete floor slab 100 is first placed and the concrete starts to cure the volume of the concrete decreases causing the slab to shrink (usually on the order of ⅛ of an inch per 20 feet). Concrete has a relatively low strength when in tension. When the internal stresses due to shrinkage 104 reach a point greater then the tensile strength of the concrete, random stress-relief cracks 102 occur.

These random cracks 102 are undesirable as they detract from the performance of the floor slab 100 and reduce its life span. Referring to FIGS. 2A and 2B, a typical method of controlling where these cracks 102 occur is to induce a weakened plane by saw cutting the top surface 200 of the concrete slab 100 into small panels, as depicted by saw cut 202.

Referring to FIG. 3, an undesirable side effect of having the floor slab 100 made up of numerous small sections is that when the floor is loaded, such as with the wheels of a moving fork lift 300, each section of the floor may be deflected 302 relative to its neighbor causing damage 304 to the joint edge, as depicted in FIG. 3.

Referring to FIG. 4, a conventional technique for reducing this type of deflection 302 is to span the joint 400 with steel bars 402 each having a round cross-section. These bars 402 are commonly referred to as dowel bars.

Referring to FIGS. 5A-5C, dowels of this type are typically assembled into a wirework frame 500 that holds the dowels at a desired depth 502 and orientation. This assembly is generally known as a dowel basket.

Using circular-cross-section dowel bars is associated with various drawbacks. For instance, if the dowel bars 402 are misaligned 600 such that they are not oriented totally perpendicular to the joint, the dowel bars 402 can lock the joint 400 thereby undesirably restraining the joint from opening, which in turn may cause random cracks 102.

Referring to FIG. 7, if a concrete floor slab, such as slabs 100-1 or 100-2, tries to move along the line of the joint 400 relative to the next panel (for instance due to shrinkage or thermal contraction), the dowel bars 402 will restrain this type of movement 700, thereby causing random cracks 102.

Referring to FIG. 8, at an intersection of two joints, movement 800, which is a combination of the two types of movement discussed above in connection with FIGS. 6 and 7, can cause a situation known as corner cracking 802.

Referring to FIGS. 9A and 9B, the round-dowel-bar drawbacks discussed above have been addressed in the past by using dowel bars 900 having a square or rectangular cross-section in conjunction with a plastic or steel clip 902 that places a compressible material 904 on the two vertical faces of the dowel bar 900. These clips 902 produce a void in the concrete wider than the dowel bar 900 allowing for sideways movement and a slight degree of misalignment. The clips 902, however, undesirably add to the expense associated with using dowel bars 900 having square and/or rectangular cross-sections. A more cost-effective solution that overcomes the misalignment problem to a greater extent, therefore, would be advantageous.

Under certain conditions, such as outdoor applications, concrete slab placement should be able to withstand concrete expansion, which is typically due to thermal changes, such as colder winter temperatures changing to warmer summer temperatures. Referring to FIG. 10, conventionally, a piece of compressible material 1000, such as foam, fiberboard, timber, or the like, is placed in an expansion joint 1002 between concrete slabs 100-1 and 100-2. A round-cross-section dowel bar 402 and an end cap 1004 may be used for transferring a load across the expansion joint 1002. As the slabs 100 expand, they move together, as indicated by arrows 1006, the joint 1002 closes, and the dowel bar 402 goes farther into the end cap 1004. This use of round-cross-section dowel bars, however, is associated with the misalignment drawback discussed above in connection with saw-cut control joints. A cost-effective way of dealing with the misalignment situation while transferring loads between concrete slabs across expansion joints 1002 would therefore be desirable.

Applicants' U.S. Pat. No. 6,354,760 discloses a load plate that overcomes the drawbacks discussed above, namely misalignment and allowing relative movement of slabs parallel to the joint. Referring to FIG. 11, the '760 patent discloses using a load plate 1100 rotated such that the load plate has a widest portion (i.e., opposite corners) of the load plate positioned in the joint between slabs 100-1 and 100-2. Using such a load plate 1100 at a construction joint works well because the load plate can be reliably centered at the construction joint between the slabs 100.

A load plate 1100 is not, however, ideally suited for use at saw-cut control joints. As described above, this type of joint results from cracking induced by a saw cut in the upper surface of a concrete slab. The saw cut may be off center with respect to any load plate embedded within the cement, as shown by the dashed line 1200 in FIG. 12. If the saw cut and joint are off-center, the load plate will not function as intended because more than half of the load plate will be fixed within one of the slabs and less than half of the load plate will be available for transferring loads to and from the other slab. Another situation for which a load plate 1100 is not ideally suited is when a construction joint, formed by an edge form, for instance, is expected to be relatively wide open. Under such circumstances, an undesirably large area of load plates 1100 may undesirably be removed from slabs on either or both sides of the joint thereby reducing the ability of the load plate 1100 to transfer loads between the slabs. For these reasons, a load transfer device that provides the advantages of the load plate of the '760 patent and that is well suited to use in saw-cut control joints and construction joints, which may become relatively wide open, would be desirable.

SUMMARY OF THE INVENTION

In accordance with an illustrative embodiment of the invention, a tapered load plate may be used to transfer loads across a joint between adjacent concrete floor slabs. The top and bottom surfaces may taper from approximately 4 inches wide to a narrow substantially pointed end 1308 over a length of approximately 12 inches. As will be apparent, other suitable tapered shapes and/or other suitable dimensions may also be used.

A tapered load plate, in accordance with an illustrative embodiment of the invention, advantageously accommodates misalignment of a saw cut for creating a control joint. Misalignment up to an angle substantially equal to the angle of the load plate's taper may be accommodated.

The tapered shape of the tapered load plate advantageously accommodates differential shrinkage of cast-in-place concrete slabs. When adjacent slabs move away from each other, the narrow end of the tapered load plate moves out of the void that it created in the slab. As the tapered load plate retracts, it will occupy less space within the void in the slab thus allowing the slabs to move relative to one another in a direction parallel to the joint.

Tapered load plates may be assembled into a load-plate basket with the direction of the taper alternating from one tapered load plate to the next. If a saw cut, used for creating a control joint, is positioned off-center relative to the tapered load plates, the alternating pattern of tapered load plates in the load-plate basket will ensure that the cross section of tapered load plate material, such as steel, spanning the joint remains substantially constant across any number of pairs of tapered load plates. For use in connection with a construction joint, an edge form may be used to position tapered load plates before the slabs are cast in place.

In accordance with an illustrative embodiment of the invention, a tapered load plate and an end cap, may be used to provide load transfer across an expansion joint. The tapered shape of the load plate will allow for misalignment. As either or both slabs expand and thereby cause the joint to close, the wide end of the tapered load plate moves farther into the end cap. This results in the allowance of an increasing amount of lateral movement between the slabs parallel to the joint 400 to the central and relatively wider portions of the tapered load plate occupying less space in the tapered void.

In accordance with an illustrative embodiment of the invention, a tapered-load-plate basket may be used to position the tapered load plates and compressible material before the concrete slabs are cast in place.

Additional features and advantages of the invention will be apparent upon reviewing the following detailed description.

DETAILED DESCRIPTION OF THE INVENTION

Figure 13:
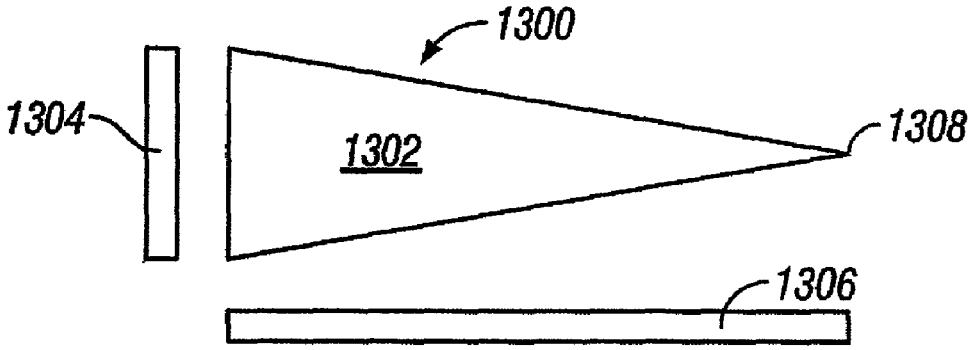
FIG. 13 shows a top and two side views of a tapered load plate in accordance with an illustrative embodiment of the invention.

Referring to FIG. 13, in accordance with an illustrative embodiment of the invention, a tapered load plate, such as tapered load plate 1300, may be used to transfer loads across a joint between adjacent concrete floor slabs. The tapered load plate 1300 may have top and bottom surfaces that are tapered, substantially planar, and substantially parallel to one another. A triangular-shaped tapered top surface 1302 and two generally rectangular-shaped side surfaces 1304 and 1306 are shown in FIG. 13. The top and bottom surfaces may taper from approximately 4 inches wide to a narrow substantially pointed end 1308 over a length of approximately 12 inches. As will be apparent, other suitable tapered shapes and/or other suitable dimensions may also be used.

Figure 14:
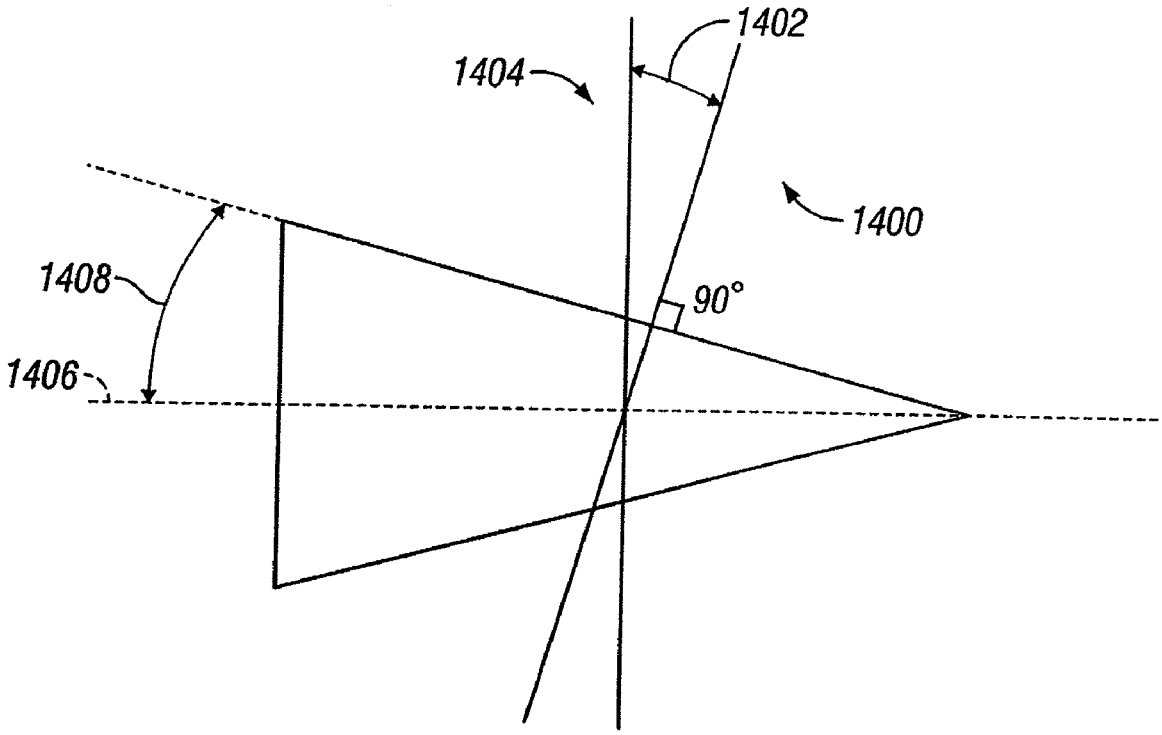
FIG. 14 is a plan view showing a misaligned saw cut relative to a tapered load plate.

A tapered load plate 1300, in accordance with an illustrative embodiment of the invention, advantageously accommodates misalignment of a saw cut for creating a control joint. Misalignment up to an angle substantially equal to the angle of the load plate's taper may be accommodated. Referring to FIG. 14, a misaligned saw cut 1400 is misaligned by an angle 1402 from correctly aligned saw cut 1404, which is oriented perpendicular to the tapered load plate's longitudinal axis 1406. The load plate's angle of taper is depicted in FIG. 14 by angle 1408.

Figure 15:
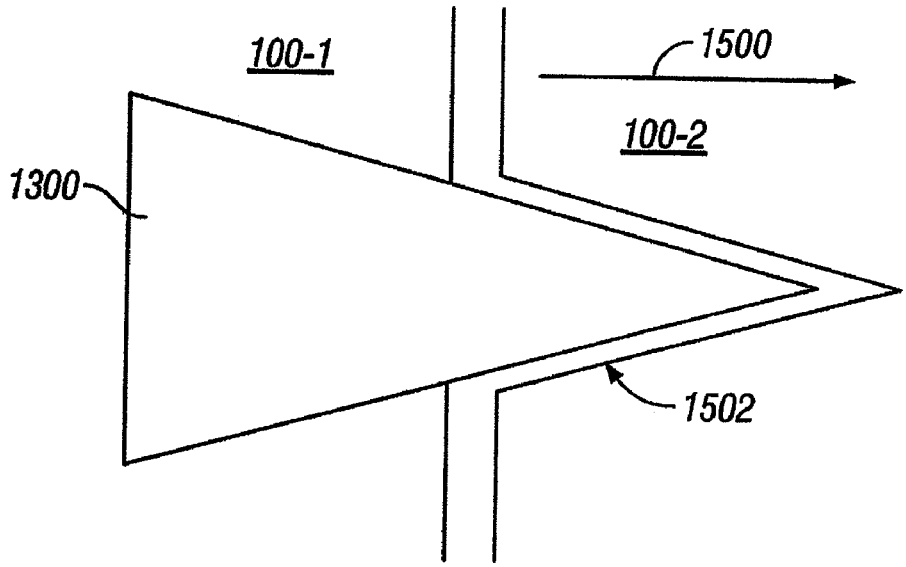
FIG. 15 is a plan view of a tapered load plate, two slabs, a joint, and a void created by the narrow end of the tapered load plate.

Referring to FIG. 15, differential shrinkage of cast-in-place concrete slabs is advantageously accommodated by the tapered shape of the tapered load plate 1300. When adjacent slabs, such as slabs 100-1 and 100-2, move away from each other, as indicated by arrow 1500, the joint 400 is said to open. As this occurs, the narrow end of the tapered load plate 1300 moves out of the void 1502 that it created in the slab 100-2. As the tapered load plate 1300 retracts in this manner, it will occupy less space within the void in the slab 100-2 thus allowing the slabs 100-1 and 100-2 to move relative to one another in a direction parallel to the joint 400. In other words, as the slabs move apart, the narrow end of the tapered load plate occupies less of the width of the tapered void 1502.

Figure 16:
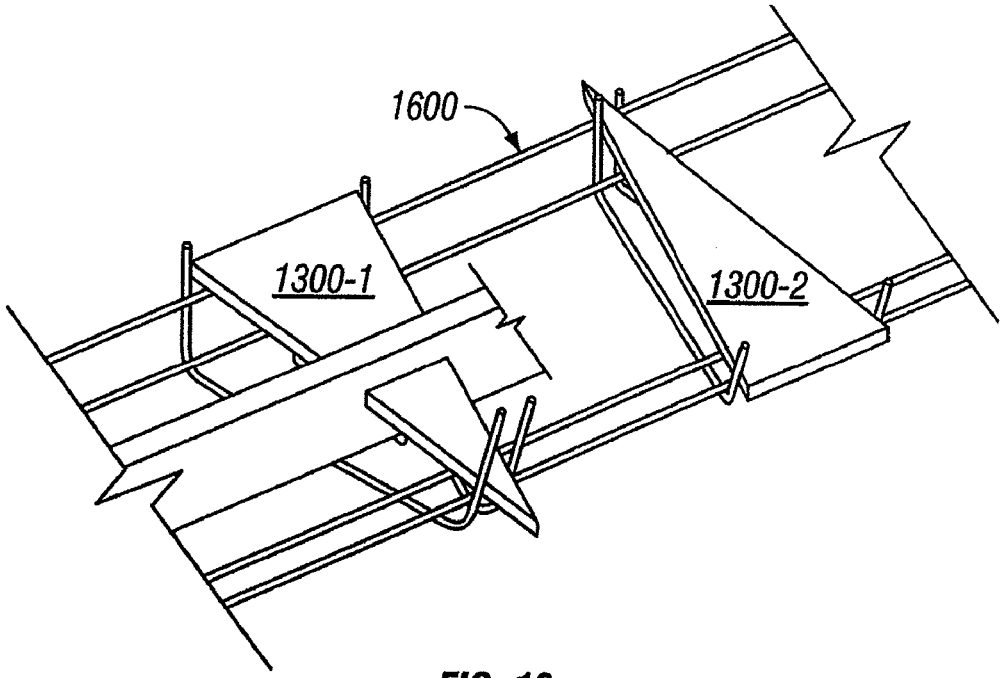
FIG. 16 shows tapered load plates in a tapered-load-plate basket, wherein the orientation of the tapered load plates alternates from one tapered load plate to the next.
Figure 17:
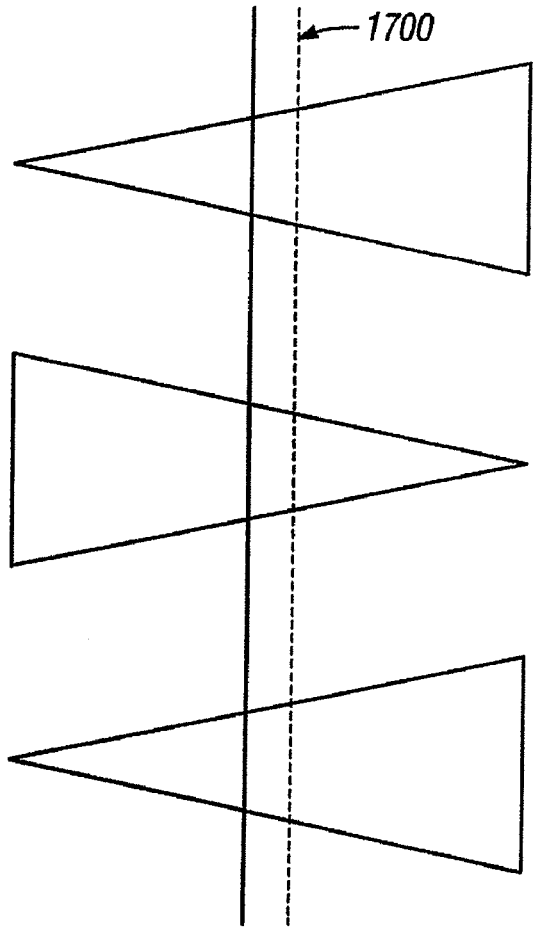
FIG. 17 is a plan view showing an off-center saw cut relative to three alternately oriented tapered load plates.

Referring to FIG. 16, tapered load plates 1300 may be assembled into a load-plate basket 1600 with the direction of the taper alternating from one tapered load plate 1300 to the next. Referring to FIG. 17, if a saw cut 1700, used for creating a control joint, is positioned off-center relative to the tapered load plates 1300, the alternating pattern of tapered load plates 1300 in the load-plate basket 1600 will ensure that the cross section of tapered load plate material, such as steel, spanning the joint remains substantially constant across any number of pairs of tapered load plates 1300. For use in connection with a construction joint, an edge form may be used to position tapered load plates before the slabs are cast in place.

Figure 1:
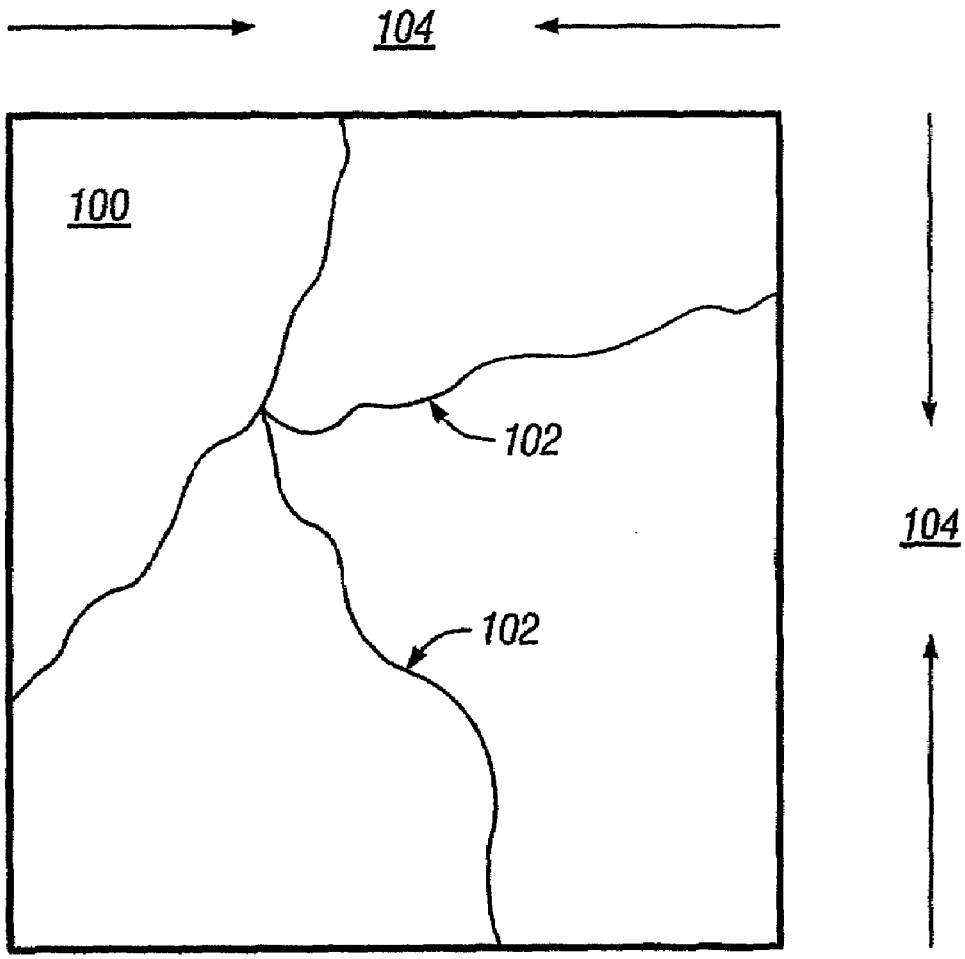
FIG. 1 is a plan view of a concrete floor slab with random cracks caused by concrete shrinkage.
Figure 2A:
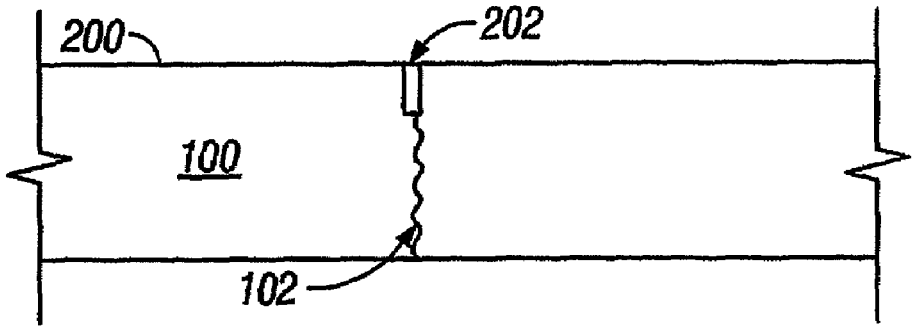
FIGS. 2A and 2B are cross-section and plan views of saw-cut control joints.
Figure 2B:
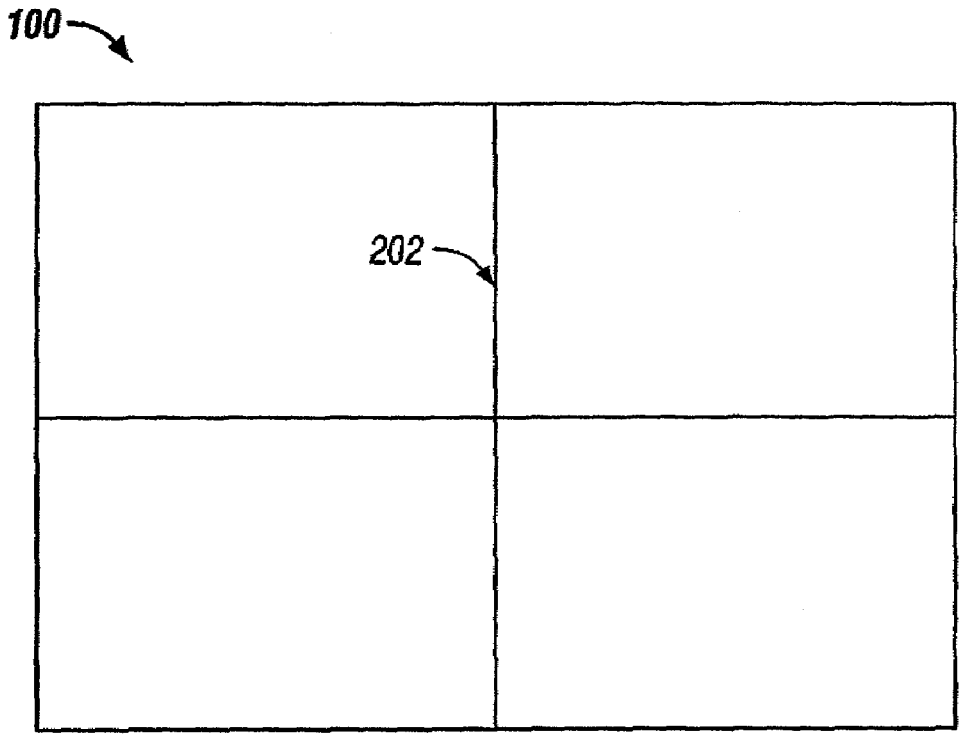
Figure 3:
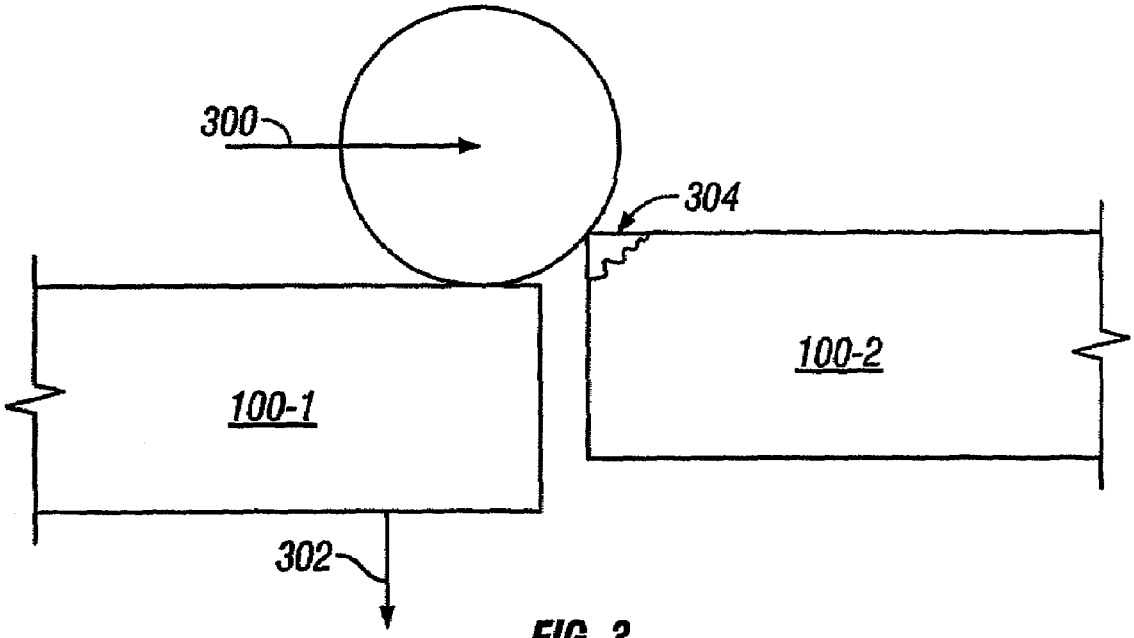
FIG. 3 depicts vertical deflection of a floor slab under a load and damage to an adjacent floor slab.
Figure 4A:
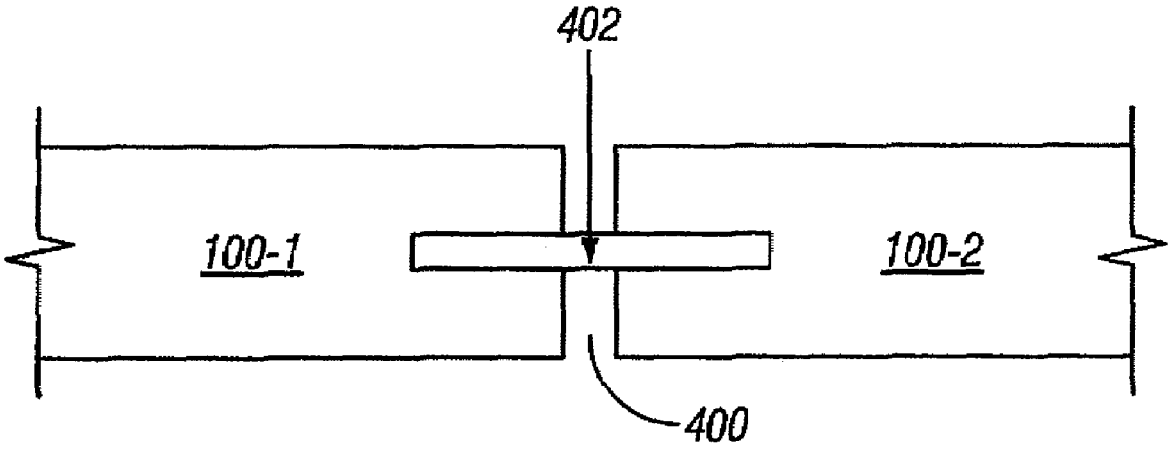
FIGS. 4A and 4B are cross section and plan view of dowel bars positioned for transferring loads across joints between adjacent slabs.
Figure 4B:
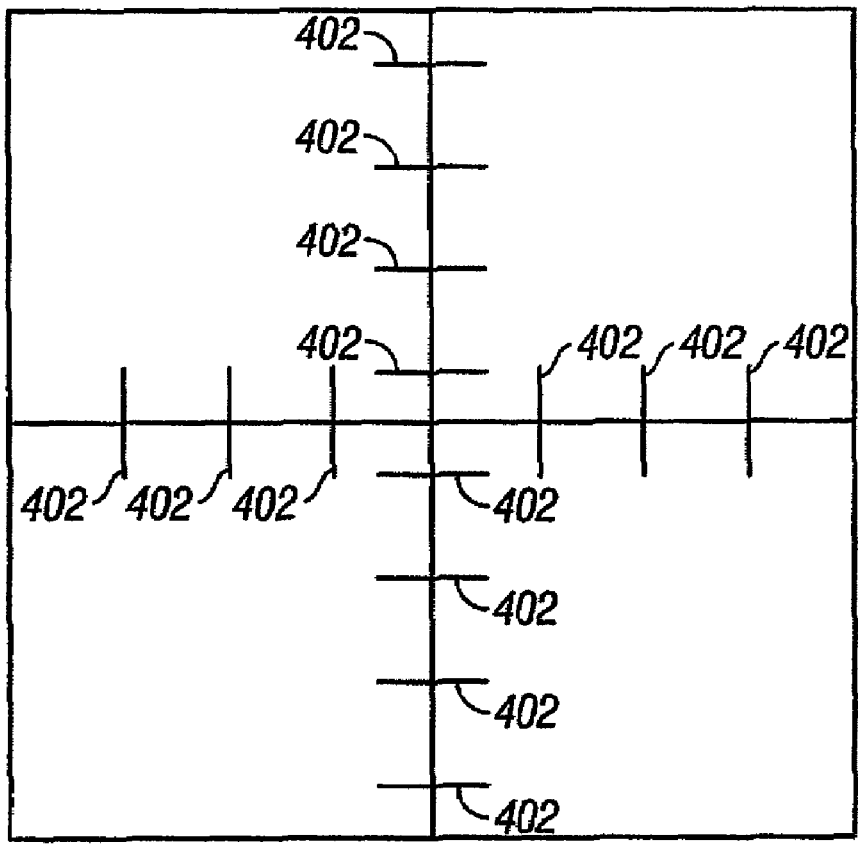
Figure 5A:
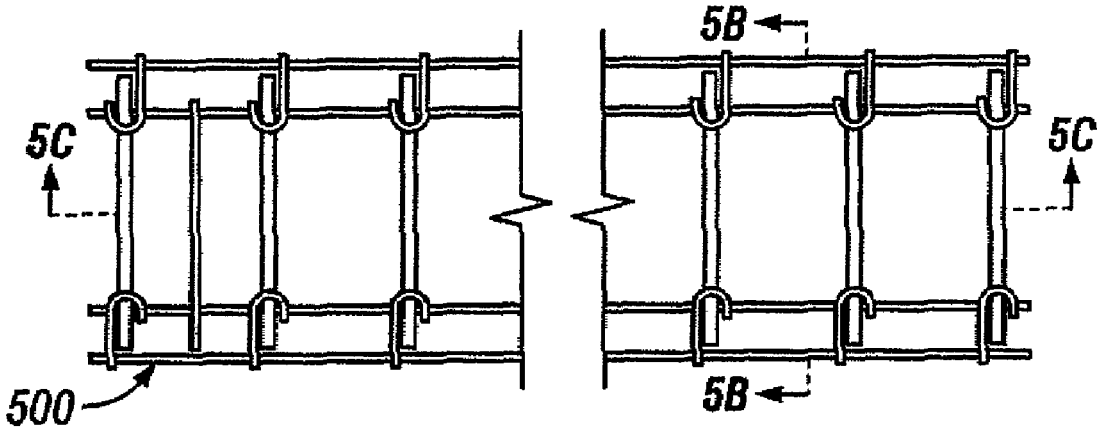
FIGS. 5A-5C are plan and sectional views of a dowel basket for positioning dowel bars before a floor slab is cast in place.
Figure 5B:
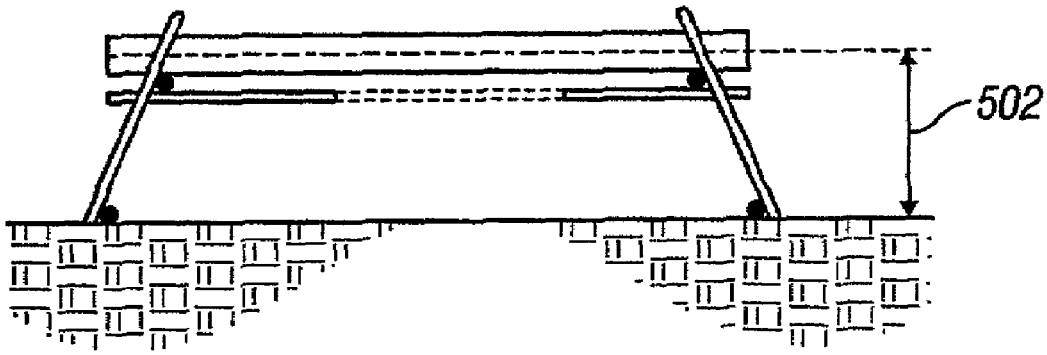
Figure 5C:
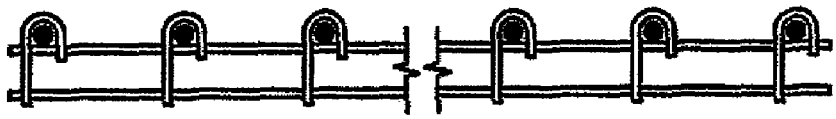
Figure 6:
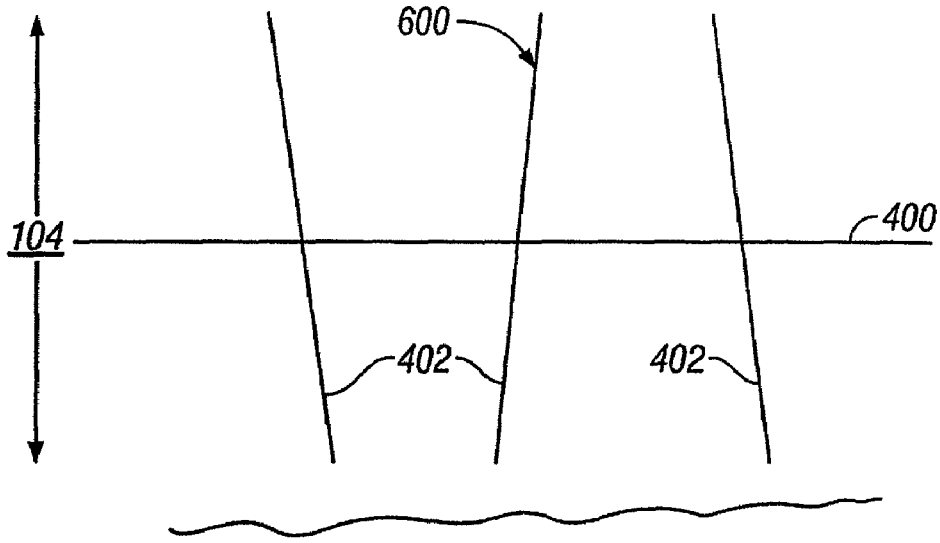
FIG. 6 is a plan view of misaligned dowel bars locking a joint and thereby causing a slab to crack.
Figure 7:
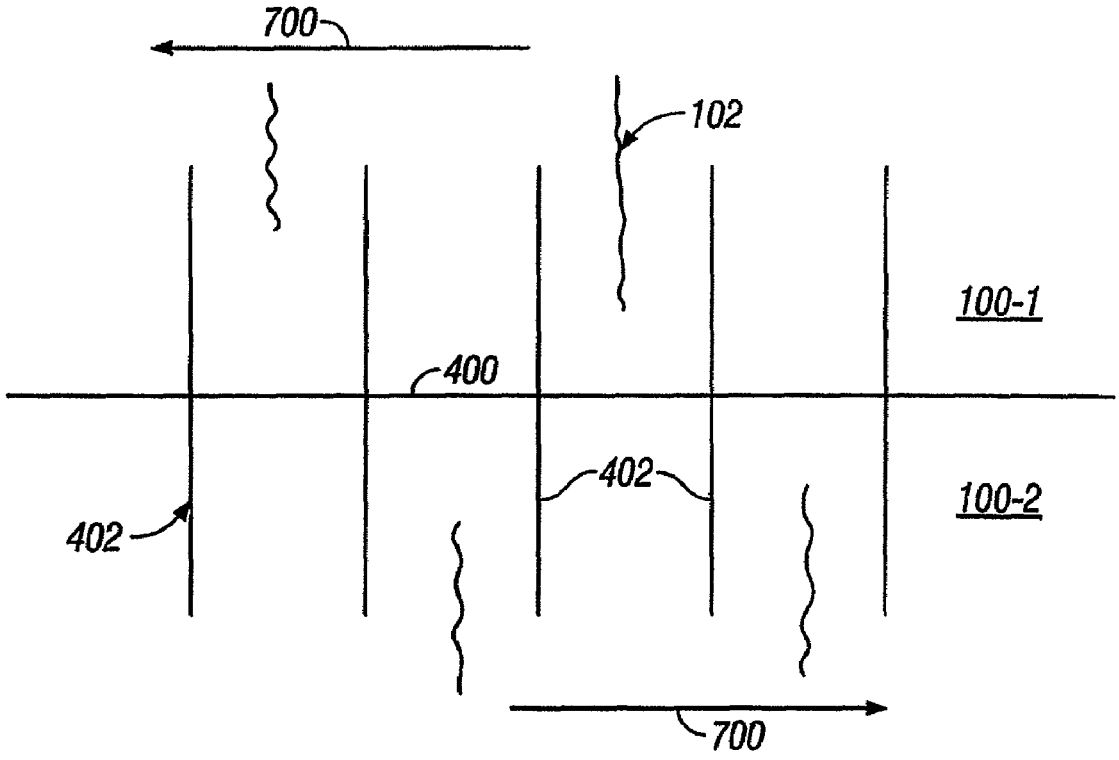
FIG. 7 is a plan view of cracks caused by dowel bars restricting relative movement of slabs parallel to the joint between the slabs.
Figure 8:
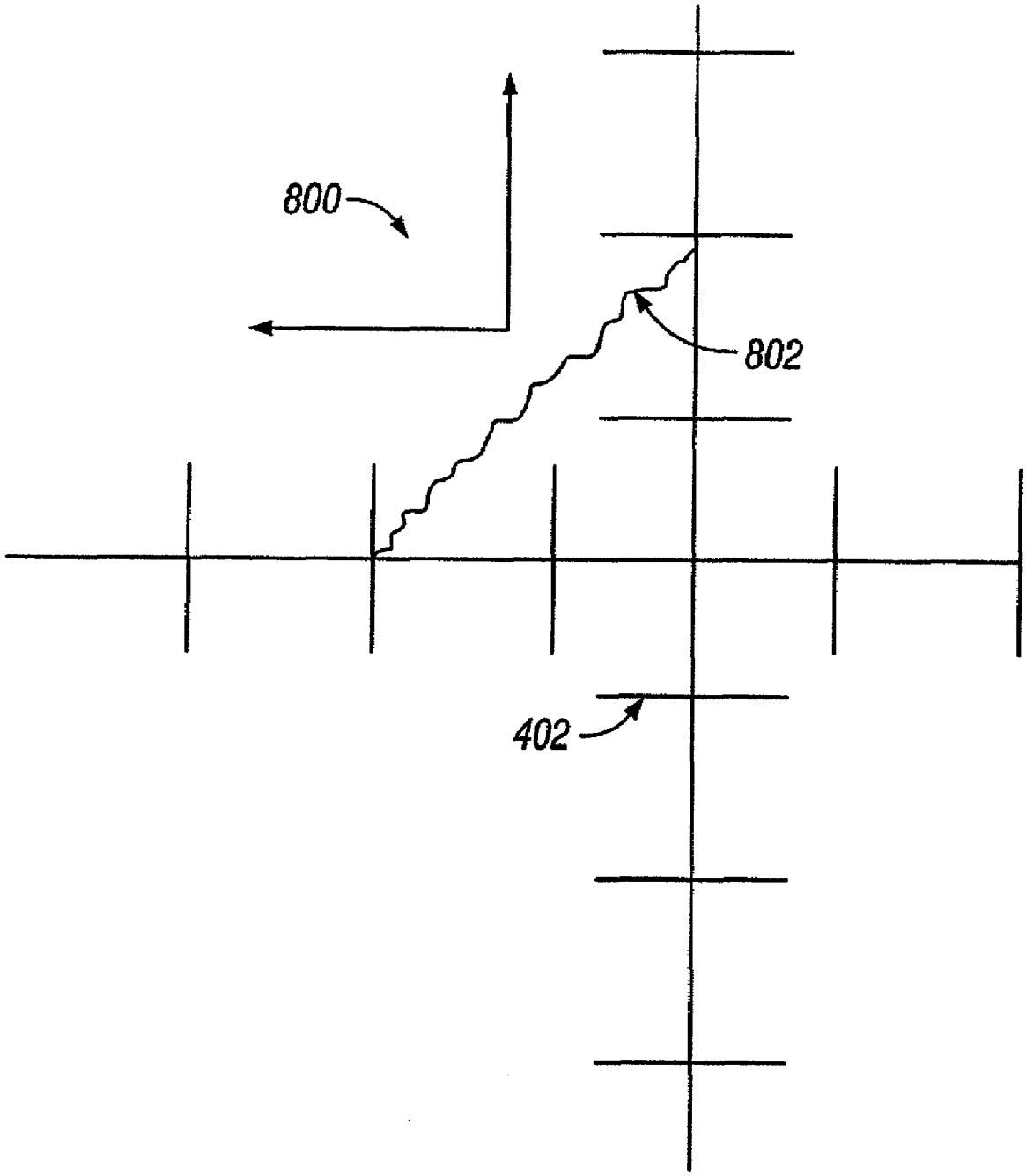
FIG. 8 is a plan view showing corner cracking due to misaligned dowel bars and restricted relative movement of slabs parallel to the joints.
Figure 9A:
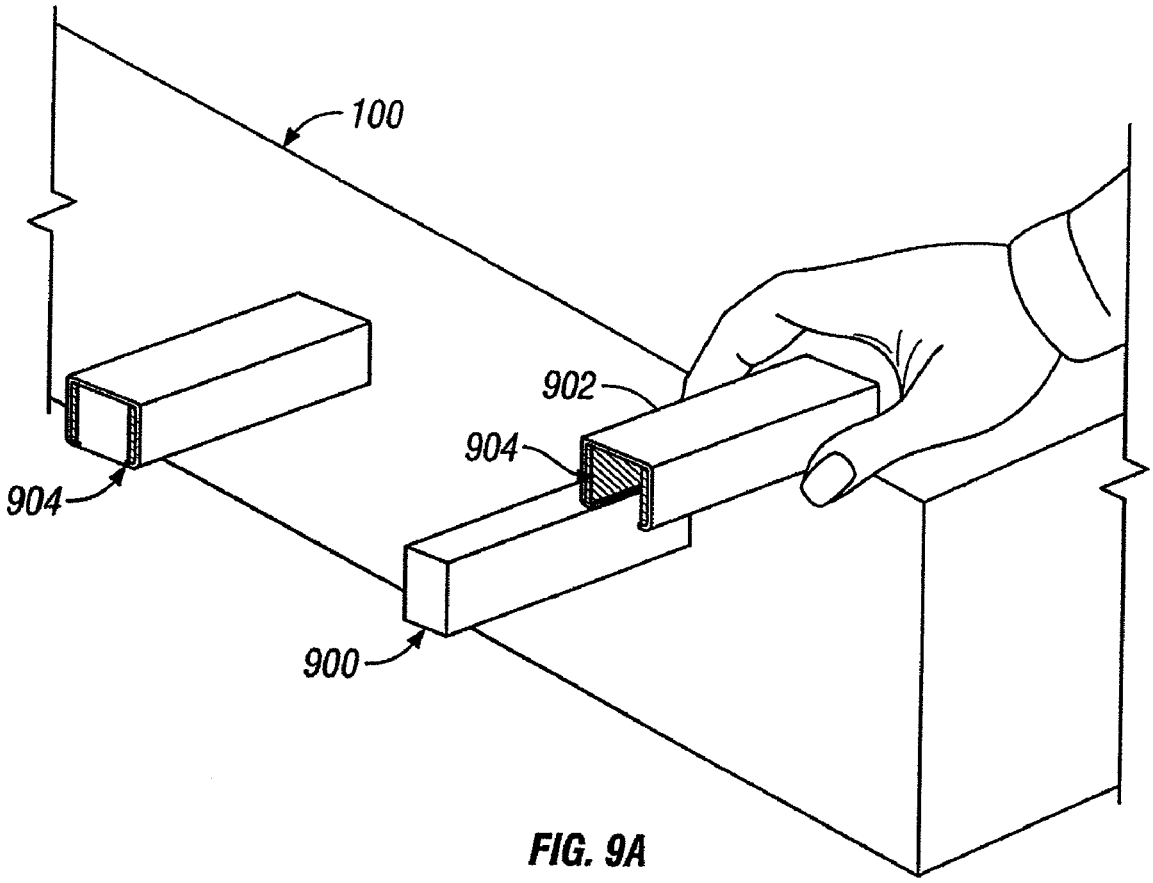
FIGS. 9A and 9B are isometric and sectional views of a square dowel and square-dowel clip.
Figure 9B:
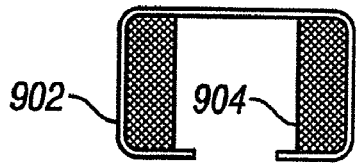
Figure 10:
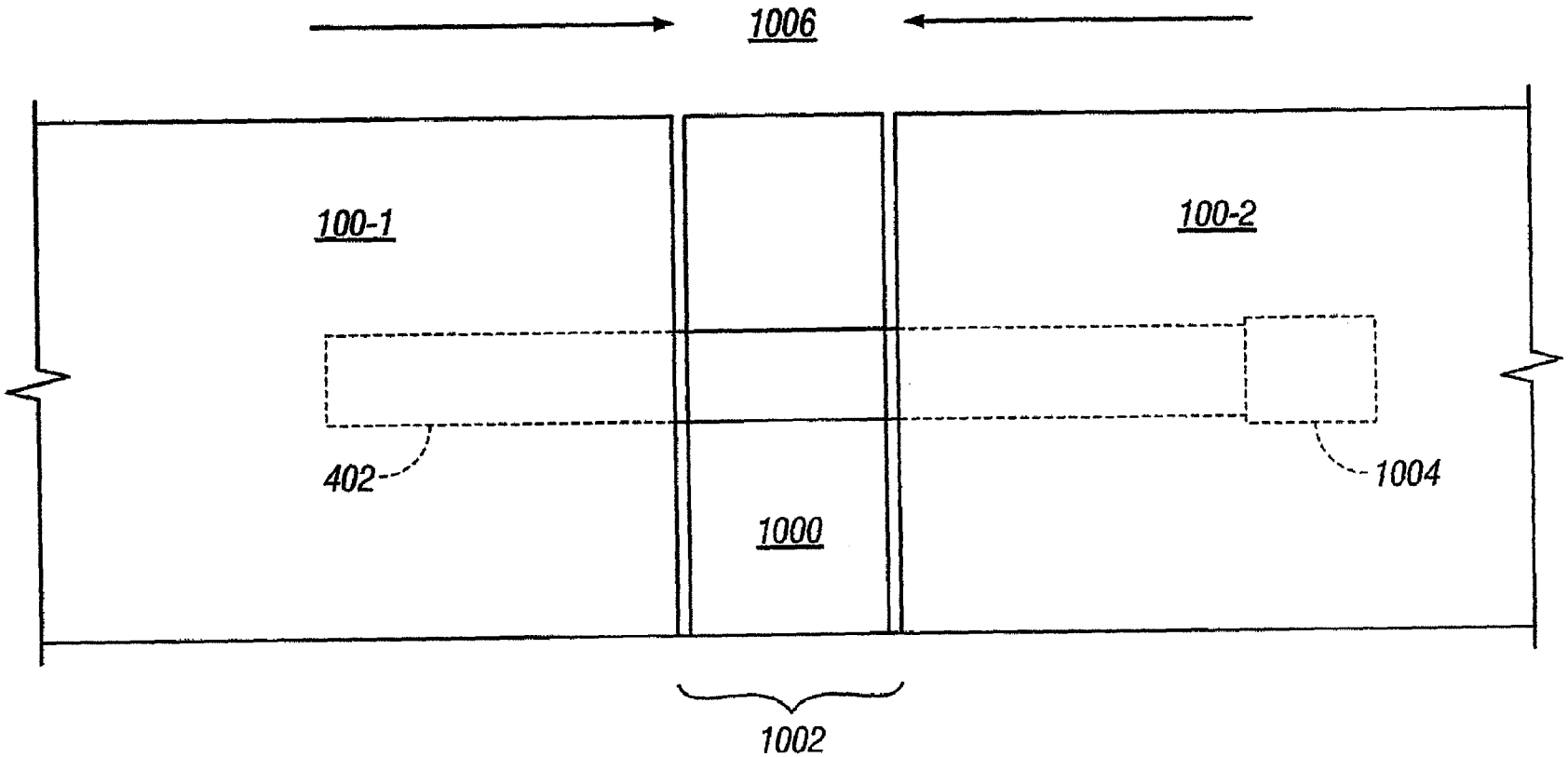
FIG. 10 is a side view of a typical expansion joint with compressible material in the joint.
Figure 11:
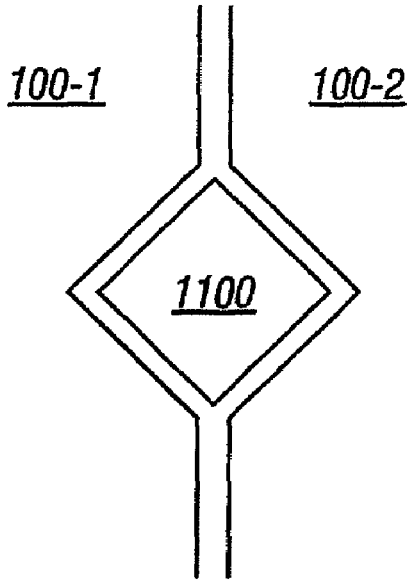
FIG. 11 is a plan view of a diamond-shaped load plate between two slabs.
Figure 12:
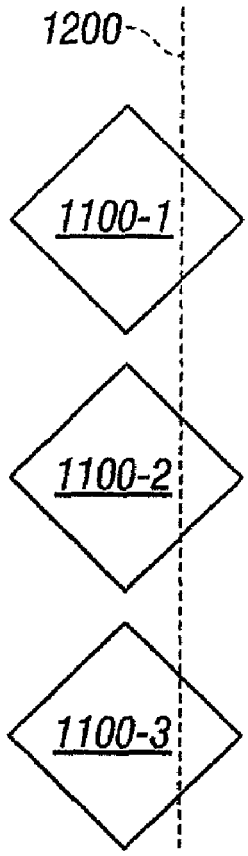
FIG. 12 is a plan view illustrating an off-center saw cut relative to diamond-shaped load plates.
Figure 18:
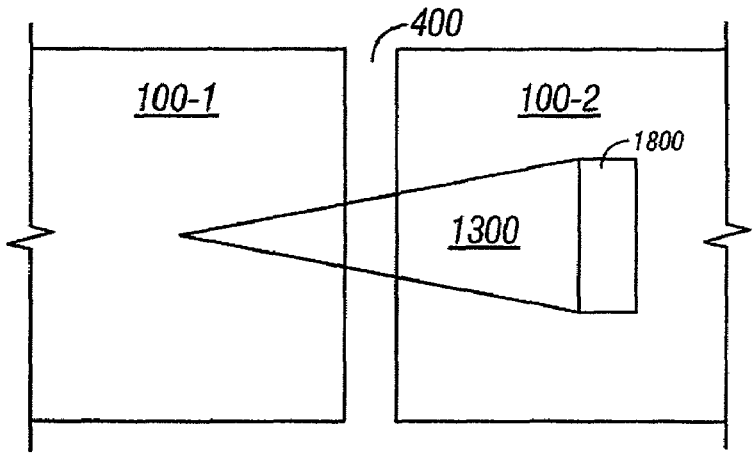
FIG. 18 is a plan view of an open expansion joint, a tapered load plate, and an end cap.
Figure 19:
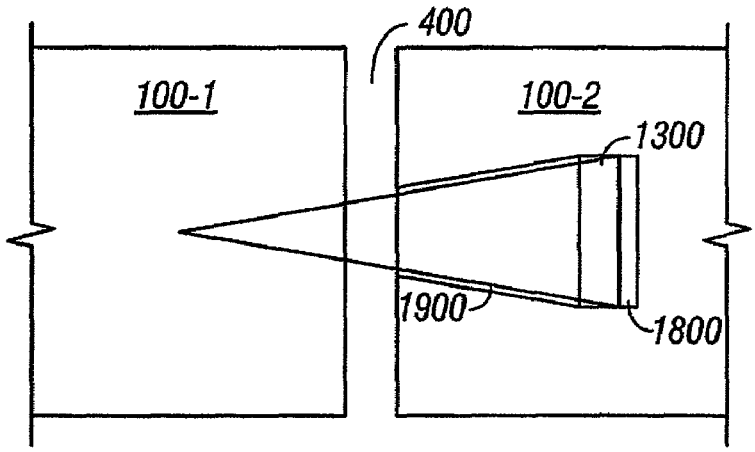
FIG. 19 is a plan view similar to FIG. 18 with the joint having closed relative to FIG. 18.

Referring to FIG. 18, in accordance with an illustrative embodiment of the invention, a tapered load plate 1300 and an end cap 1800 may be used to provide load transfer across an expansion joint of the type discussed above in connection with FIG. 10. The tapered shape of the load plate 1300 will allow for misalignment, as discussed above in connection with FIG. 14. As either or both slabs 100-1 and 100-2 expand and thereby cause the joint 400 to close, the wide end of the tapered load plate 1300 moves farther into the end cap 1800. This results in the allowance of an increasing amount of lateral movement between the slabs 100-1 and 100-2 parallel to the joint 400 due to the central and relatively wider portions of the tapered load plate occupying less space in the tapered void 1900.

Figure 20:
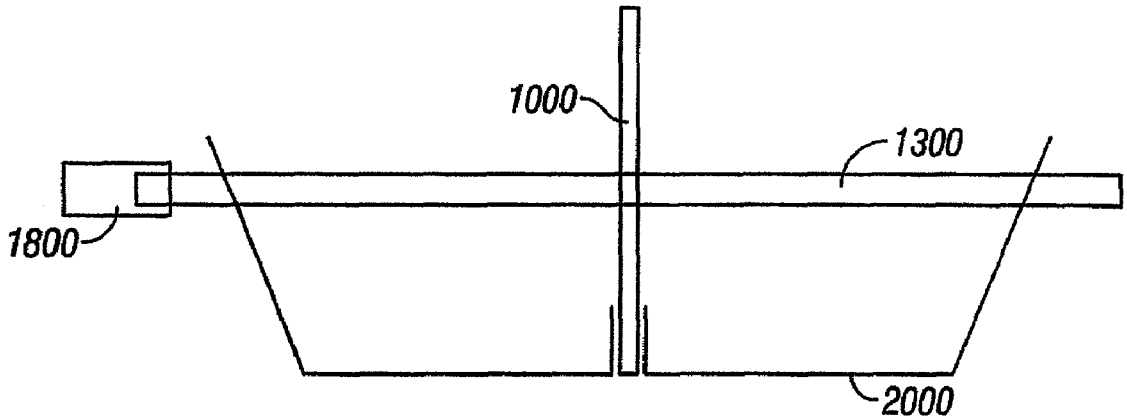
FIG. 20 is a side view of an expansion-type tapered-load-plate basket, compressible material, a tapered load plate, and an end cap.

Referring to FIG. 20, in accordance with an illustrative embodiment of the invention, a tapered-load-plate basket 2000 may be used to position the tapered load plates 1300 and compressible material 1000 before the concrete slabs 100 are cast in place.

While the invention has been described with respect to specific examples including presently preferred modes of carrying out the invention, the invention is limited only by the following claims.

We claim:

1. Apparatus for use in a system for transferring loads between a first concrete on-ground cast-in-place slab and a second concrete on-ground cast-in-place slab, the system comprising the first and second slabs and a joint interposing the first and second slabs, at least the first slab having a substantially planar upper surface, at least a portion of the joint being initially defined by at least one of a crack, cut or a form oriented substantially perpendicular to the substantially planar upper surface of the first slab, wherein a longitudinal axis of the joint is formed by an intersection of the crack, cut or form and the upper surface of the first slab and wherein the joint is subject to opening through a variety of joint opening dimensions;

the apparatus comprising:

a first tapered load plate and a second tapered load plate that each have a taper, protrude in use into the first and second slabs and have an extent in use across the joint such that the load plates span the joint and transfer between the first and second slabs a load applied to either of the slabs directed substantially perpendicular to the upper surface of the first slab; the tapered load plates each having a width in use measured parallel to the longitudinal axis of the joint; the width of each tapered load plate generally tapering from a relatively wide location in the extent of each plate across the joint to a relatively narrow portion;

whereby in use, as the joint opens, a tapered gap opens between the load plate and the slab near the narrow portion such that the slabs are allowed increasingly greater relative movement in the direction substantially parallel to the longitudinal axis of the joint; and whereby in use the first and second tapered load plates are oriented such that as the joint opens, reduced width of one load plate at the narrowest width in the joint of the one load plate due to plate taper is compensated for by increased width of the other load plate in the joint due to opposing plate taper, such that as the joint opens, the combined widths of the first and second tapered load plates in the joint is substantially consistent for substantially consistent load transfer across the joint; and whereby in use the tapered load plates restrict relative movement between the first and second slabs in a direction substantially perpendicular to the upper surface of the first slab, allow the joint to open by allowing the first and second slabs to move away from each other in a direction substantially perpendicular to the joint, allow for increasingly greater relative movement in a direction substantially parallel to the longitudinal axis of the joint as the joint opens, and maintain substantially consistent load transfer across the joint.

2. The apparatus of claim 1, wherein the tapered load plates in use each have a length measured perpendicular to the joint that is substantially greater than the wide portions.

3. The apparatus of claim 1, wherein:

the tapered load plates' wide portions are wide ends; and the tapered load plates' narrow portions taper to respective substantially narrow ends.

4. The apparatus of claim 1, further comprising a tapered-load-plate basket that positions the tapered load plates before the slabs are cast in place.

5. The apparatus of claim 1, wherein in use the first tapered load plate's wide portion protrudes into the first slab and the second tapered load plate's wide portion protrudes into the second slab.

6. Apparatus for transferring loads between a first concrete on-ground cast-in-place slab and a second concrete on-ground cast-in-place slab, the apparatus for use in a system, the system comprising:

a joint separating first and second slabs, at least a portion of the joint being initially defined by a partial depth saw cut that results in a crack below the saw cut, wherein a longitudinal axis of the partial depth portion of the joint formed by the saw cut is formed by an intersection of the saw cut and the upper surface of the first slab;

the apparatus comprising:

a first load plate and a second load plate that in use each protrude into the first and second slabs such that the load plates transfer between the first and second slabs a load applied to either of the slabs directed substantially perpendicular to the upper surface of the first slab;

whereby the load plates restrict relative movement between the first and second slabs in a direction substantially perpendicular to the upper surface of the first slab, and the load plates allow the joint to open by allowing the first and second slabs to move away from each other in a direction substantially perpendicular to the joint;

the load plates each having a width measured in use parallel to the longitudinal axis of the joint; and wherein the width of each load plate generally tapers from a relatively wide portion near the joint to at least one relatively narrow end in at least one of the slabs such that, as the joint opens, the slabs are allowed increasingly greater relative movement in a direction substantially parallel to the longitudinal axis of the joint; and wherein the tapered load plates define in use a cross section of tapered load plate material spanning the joint, and the cross section remains substantially constant between the saw cut being positioned on-center relative to the tapered load plates and the saw cut being, in at least one position of the saw cut, off-center relative to the tapered load plates.

7. The apparatus of claim 6, wherein the load plates taper to respective substantially pointed ends.

8. The apparatus of claim 6, further comprising a load-plate basket that positions the load plates before the slabs are cast in place.

9. The apparatus of claim 6, wherein the first load plate's relatively narrow end protrudes in use into the first slab and the second load plate's relatively narrow end protrudes in use into the second slab.

10. The apparatus of claim 6, wherein the width of each load plate in use generally tapers from a relatively wide end to the relatively narrow end.

11. The apparatus of claim 10, wherein the first relatively narrow end tapers to a first substantially pointed end.

12. The apparatus of claim 11, wherein the second relatively narrow end tapers to a second substantially pointed end.

13. Apparatus for use in a system transferring loads between a first concrete on-ground cast-in-place slab and a second concrete on-ground cast-in-place slab, the system comprising the first and second slabs and a joint interposing the first and second slabs, at least the first slab having a substantially planar upper surface, at least a portion of the joint being initially defined by at least one of a crack, cut or a form oriented substantially perpendicular to the substantially planar upper surface of the first slab, wherein a longitudinal axis of the joint is formed by an intersection of the crack, cut or form and the upper surface of the first slab and wherein the joint is subject to opening through a variety of joint opening dimensions;

the apparatus comprising:

multiple first tapered load plates and multiple second tapered load plates, that each have a taper, protrude in use into the first and second slabs and have an extent in use across the joint such that the load plates span the joint and transfer between the first and second slabs a load applied to either of the slabs directed substantially perpendicular to the upper surface of the first slab; the tapered load plates each having a width in use measured parallel to the longitudinal axis of the joint; the width of each tapered load plate generally tapering from a relatively wide location in the extent of each plate across the joint to a relatively narrow portion; and a tapered-load-plate basket that facilitates positioning the tapered load plates in the area of the joint before the slabs are cast in place;

whereby in use, as the joint opens, a tapered gap opens between the load plates and the slabs near the narrow portions of the plates such that the slabs are allowed increasingly greater relative movement in the direction substantially parallel to the longitudinal axis of the joint; and whereby in use the multiple first and multiple second tapered load plates are oriented such that as the joint opens, reduced width of the first load plates at the narrowest width in the joint of the first load plates due to plate taper is compensated for by increased width of the second load plates in the joint due to opposing plate taper, such that as the joint opens, the combined widths of the multiple first and second tapered load plates in the joint is substantially consistent for load transfer across the joint; and whereby in use the tapered load plates restrict relative movement between the first and second slabs in a direction substantially perpendicular to the upper surface of the first slab, allow the joint to open by allowing the first and second slabs to move away from each other in a direction substantially perpendicular to the joint, allow for increasingly greater relative movement in a direction substantially parallel to the longitudinal axis of the joint as the joint opens, and maintain substantially consistent load transfer across the joint.

* * * * *